United States Patent [19]

Coston

[11] Patent Number: 4,997,037

[45] Date of Patent: Mar. 5, 1991

[54] DOWN HOLE SHOCK ABSORBER

[76] Inventor: Hughes A. Coston, 5869 S. 76 E. Ave., Tulsa, Okla. 74145

[21] Appl. No.: 385,814

[22] Filed: Jul. 26, 1989

[51] Int. Cl.[5] ..... F04B 21/04

[52] U.S. Cl. ..... 166/105; 74/581

[58] Field of Search ..... 166/105, 106, 369; 74/381, 382, 581

[56] References Cited

U.S. PATENT DOCUMENTS

| | | | |
|---|---|---|---|
| 1,784,110 | 12/1930 | Ricker . | |
| 2,248,305 | 7/1941 | Rasmussen | 166/2 |
| 2,386,593 | 10/1945 | Carter | 166/105 |
| 3,209,834 | 10/1965 | Essary | 166/105 X |
| 3,412,798 | 11/1968 | Gregston | 166/68 |
| 3,628,606 | 12/1971 | Bernard | 166/170 |
| 4,070,134 | 1/1978 | Gramling | 417/56 |
| 4,176,714 | 12/1979 | Case | 74/581 X |
| 4,354,395 | 10/1982 | Page, Jr. | 74/581 X |
| 4,354,397 | 10/1982 | Fix | 74/582 |
| 4,410,038 | 10/1983 | Drapp | 166/53 |
| 4,445,674 | 5/1984 | Clayton, Jr. | 74/41 X |
| 4,571,162 | 2/1986 | Knox | 417/554 |
| 4,595,060 | 6/1986 | Beck | 166/373 |
| 4,629,004 | 12/1986 | Griffin | 166/372 |
| 4,650,001 | 3/1987 | Ringgenberg | 166/373 |
| 4,661,052 | 4/1987 | Ruhle | 417/552 |

*Primary Examiner*—William P. Neuder
*Attorney, Agent, or Firm*—Head & Johnson

[57] ABSTRACT

A downhole chock absorber reduces or eliminates fluid and gas pound in a pumping system employing a well pump mounted at the bottom of a sucker rod string. A substantially cylindrical coupling has coaxial, internally threaded upper and lower segments. The lower segment is screwable onto a complementary, externally threaded, upper end of a member of the sucker rod string. A shaft with a complementary externally threaded lower end is screwed into the internally threaded upper segment of the coupling. A plurality of diametric holes are vertically displaced and sequentially, circumferentially offset along the upper portion of the shaft. A spring slidably, coaxially disposed on the shaft below the holes is seated on the coupling. The spring has an outer diameter less than the outer diameter of the coupling to reduce the possiblity of the spring wearing against the pump system production line tubing. Several pins, one for each of the holes, are snugly disposed through the holes and protrude beyond the circumference of the shaft at both ends. Each of the pins is preferably a flexibly resilient spiraled coil of steel. A cylinder slidably disposed on the shaft is seated on the spring. The cylinder is longer than the length of the portion of the shaft extending above the coupling less the compressed length of the spring. The cylinder has at least one relief port which lies above the shaft when the spring is compressed to its elastic limit. The cylinder also has two vertical slots aligned with each of the pins with opposite ends of the pins protruding into their respective pair of slots. The pins slide reciprocally in the slots. The slots are long enough that the upper end of each slot does not engage its respective pin when the spring is fully compressed but the lower end of each slot does engage its respective pin when or after the spring is fully expanded. The cylinder also has an internally threaded upper end which screws onto a complementary threaded lower end of a member of the sucker rod string disposed above the cylinder.

The spring biased shaft and cylinder absorb the forces transmitted to them through the sucker rod string members to which they are attached. The closer the shock absorber is mounted to the pump, where fluid and gas pound are initiated, the greater the protective value of the shock absorber. If the elastic limits of the spring are exceeded and the spring damaged, the shock absorber can easily be pulled with the sucker rod string, the pins popped out of the shaft, the cylinder removed and the spring replaced.

30 Claims, 3 Drawing Sheets

DOWN HOLE SHOCK ABSORBER

BACKGROUND OF THE INVENTION

This invention relates generally to equipment for maximizing efficiency of oil well pump systems and more particularly concerns shock absorbers for reducing or eliminating the damaging effects caused to such systems by fluid or gas pound.

In a publication entitled *Recommended Practice for Care and Use of Subsurface Pumps*, API Specification 11AR (RP11AR) 2nd Ed., March, 1982, the American Petroleum Institute identifies fluid pound and gas pound as two common pump problems, describes their damaging effects and offers solutions commensurate with prior art principles. Briefly stated, fluid and gas pound produce shock waves which will impose a severe shock load on an entire pumping system. Eventually these forces will manifest themselves as fatigue failure in the pumping unit base, structure, gear teeth and bearings, in the rod string, in various pump assembly parts and in the production tubing.

One solution proposed for fluid pound is to constrain the pounding effect to the early downstroke when pump plunger velocity is lower. Another solution offered is to match pump displacement to well productivity. Obviously, such solutions alleviate fluid pound damage at the expense of system efficiency and even require short term shut down periods. But this compromise is accepted because of the severity of the alternative.

The proposed solutions for gas pound include changing the subsurface separators and cleaning of pump fillage restrictions. While these solutions cause relatively modest system down time for changeovers, they are at best temporary, particularly when scale and undesirable solid particles increase separator and valve plugging problems.

Considering the relative inadequacy of the solutions proffered for such costly problems, it is clear that there is considerable room for innovation in the art. To this end, above-ground shock absorbers have been designed which provide limited beneficial results. In a typical example, the shock absorber is used to connect the oil well polished rod to its pumping unit. However, while this shock absorber diminishes the shock waves transmitted from the polished rod to the pumping unit and thus offers protection to the above-ground pump elements, the full impact of the waves is still transmitted all those pump system components located below the polished rod. Consequently, all below-ground pump elements remain subject to damage. Despite this improvement down time remains costly because, regardless of whether it is caused by an above-ground or a downhole failure, the system is still inoperable. It's not enough to solve half the problem. Perhaps this is why above-ground shock absorbers, some of which preceded the above referenced publication, were not identified as a solution by the American Petroleum Institute.

It is, therefore, an object of this invention to provide a shock absorber that will diminish or eliminate the problems caused by fluid and gas pound. Accordingly, it is an object of this invention to provide a shock absorber that is effective to reduce or absorb the shock waves generated throughout a pumping system under fluid and gas pound conditions. A related object of the invention is to provide a shock absorber located at or near the downhole pump so as to absorb shock waves prior to their transmission through the system to the surface. And it is an object of this invention to provide a shock absorber which is easily installed in and removed from a pump system.

SUMMARY OF THE INVENTION

In accordance with the invention a downhole shock absorber is provided for use with a well pump mounted at the bottom of a sucker rod string. A substantially cylindrical coupling has coaxial, internally threaded upper and lower segments, the lower segment being screwable onto a complementary externally threaded upper end of a member of the sucker rod string. A shaft with a complementary externally threaded lower end is screwed into the internally threaded upper segment of the coupling. A plurality of diametric holes are vertically displaced and sequentially, circumferentially offset along the upper portion of the shaft. A spring slidably, coaxially disposed on the shaft below the holes is seated on the coupling. The spring has an outer diameter less than the outer diameter of the coupling to reduce the possibility of the spring wearing against the pump system production tubing. Several pins, one for each of the holes, are snugly disposed through the holes and protrude beyond the circumference of the shaft at both ends. Each of the pins is preferably a flexibly resilient spiraled coil of steel. A cylinder slidably disposed on the shaft is seated on the spring. The cylinder is longer than the length of the portion of the shaft extending above the coupling less the compressed length of the spring. The cylinder has at least one relief port which lies above the shaft when the spring is compressed to its elastic limit. The cylinder also has two vertical slots aligned with each of the pins with opposite ends of the pins protruding into their respective pair of slots. The pins slide reciprocally in the slots. The slots are long enough that the upper end of each slot does not engage its respective pin when the spring is fully compressed but the lower end of each slot does engage its respective pin when or after the spring is fully expanded. The cylinder also has an internally threaded upper end which screws onto a complementary threaded lower end of a member of the sucker rod string disposed above the cylinder.

The spring biased shaft and cylinder absorb the forces transmitted to them through the sucker rod string members to which they are attached. The closer the shock absorber is mounted to the pump, where fluid and gas pound are initiated, the greater the protective value of the shock absorber. If the elastic limits of the spring are exceeded and the spring damaged, the shock absorber can easily by pulled with the sucker rod string, the pins popped out of the shaft, the cylinder removed and the spring replaced.

BRIEF DESCRIPTION OF THE DRAWINGS

Other objects and advantages of the invention will become apparent upon reading the following detailed description and upon reference to the drawings, in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
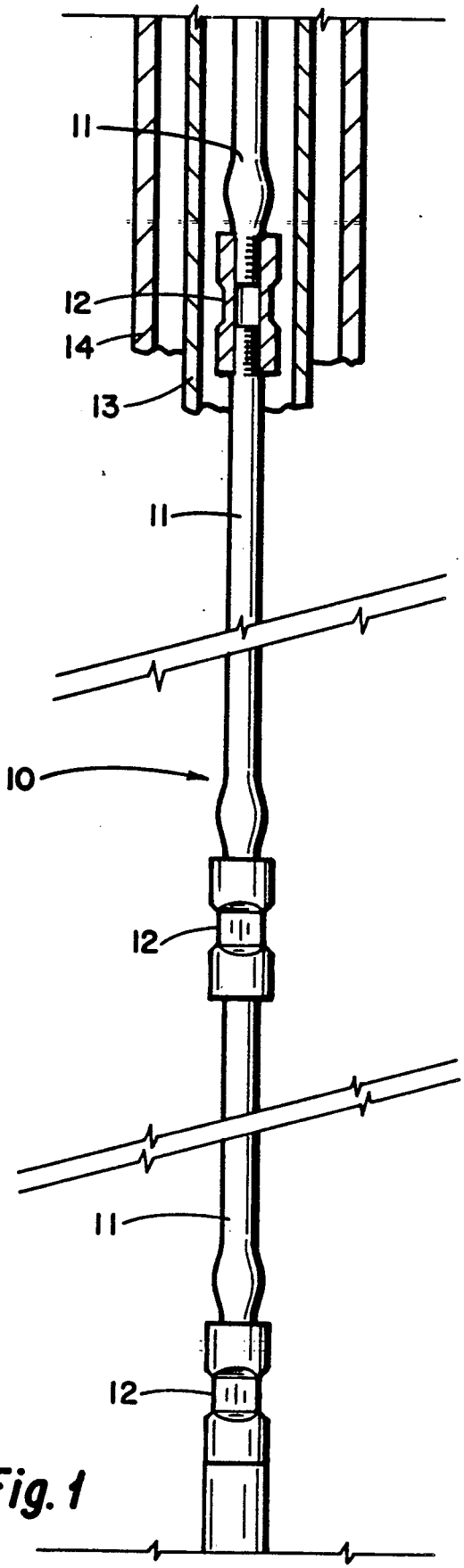
FIG. 1 is a cross-sectional view illustrating the members of the bottom end of a sucker rod string connected to a downhole pump as typically used in the prior art.

FIG. 1 illustrates a typical downhole arrangement of the bottom end of a sucker rod string 10 which extends to the downhole pump of a pumping system (not shown). The string 10 consists of a series of members 11 joined together by couplings 12 for a length of perhaps thousands of feet into the production tubing 13 within the well casing 14. The final member of the rod string 10 may be what is known as a polished or pull or valve rod and connects the string 10 to the pump itself (not shown). One or more of the members immediately above the polished or pull or valve rod may be what is known as a sinker rod. Sinker rods are heavier than the normal sucker rods and therefore tend to pull the string in a downward direction. Whatever the specific nature of these bottom end rods, they are all referred to as members of the sucker rod string 10 for the purpose of this disclosure. Given the relatively rigid, coaxially coupled arrangement of the member 11, it is easily seen that when ever the pump valve is not filled with fluid, the downstroke can cause an impact at fluid contact that will transmit tremendous shock forces to the pump and the entire pumping system. The compression and expansion of the member 11 during the downstroke and upstroke, respectively, will only partially absorb these shock forces. Above ground shock absorbers are effective only to reduce the upstroke forces.

Figure 2:
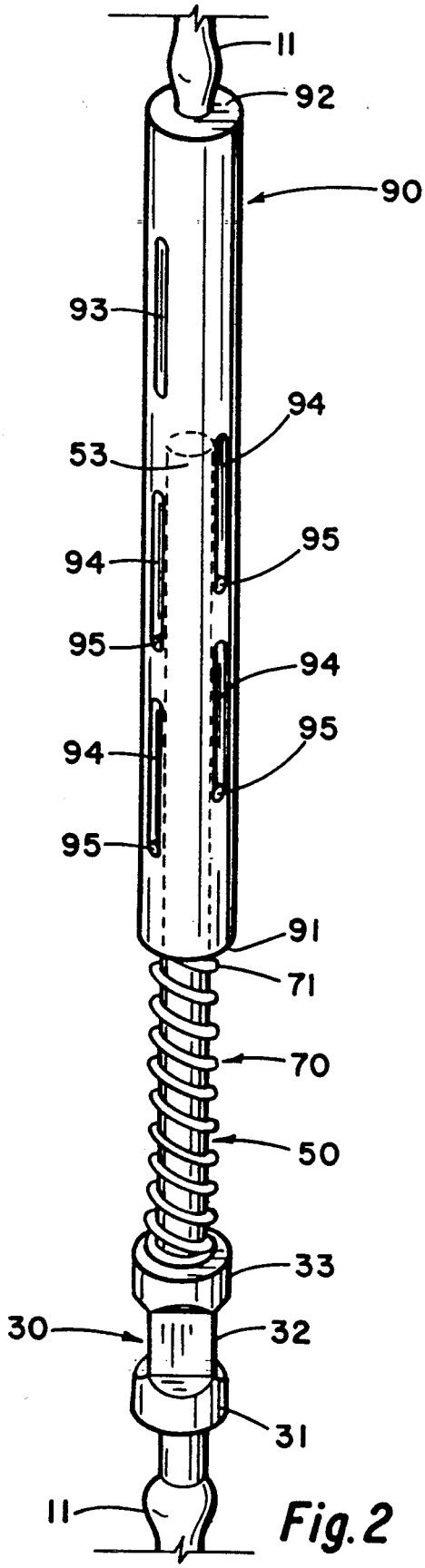
FIG. 2 is is a perspective view of a preferred embodiment of the downhole shock absorber mounted in the sucker rod string assembly shown in FIG. 1.

A downhole shock absorber which will reduce or eliminate the downstroke forces generated by fluid and gas pound is illustrated in FIG. 2. In its optimum use, the downhole sucker absorber will be inclined in the sucker rod string 10 shown in FIG. 1 between the final and immediately preceding members 11 of the string 10, though it could be included further up the string. Indeed, more than one shock absorber could be located in the same string.

Figure 3:
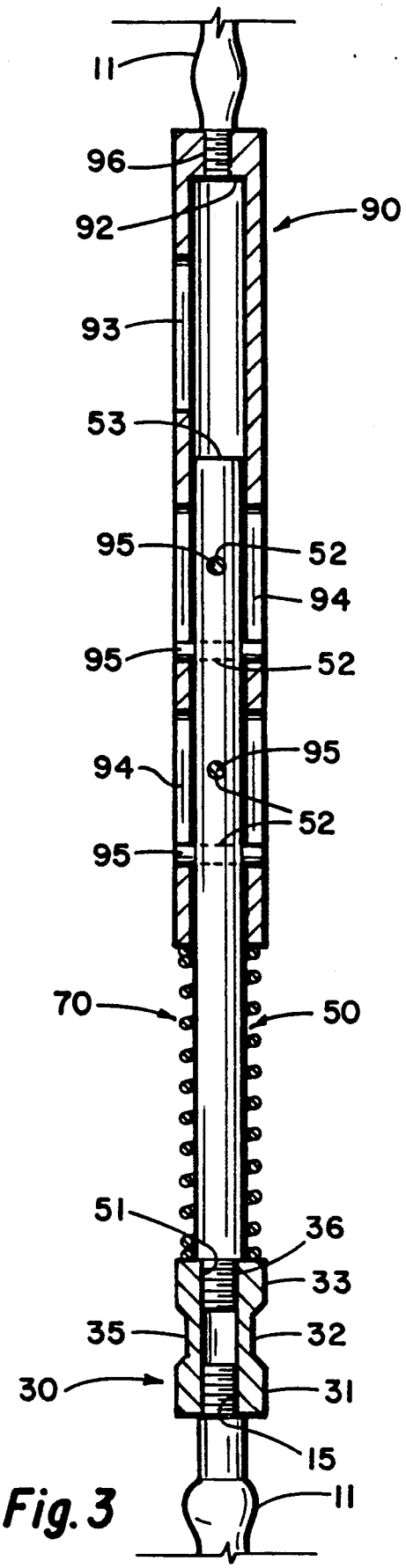
FIG. 3 is a cross-sectional view of the preferred embodiment of FIG. 2 illustrating the relationship of the parts of the shock absorber at the beginning of the pump downstroke.
Figure 4:
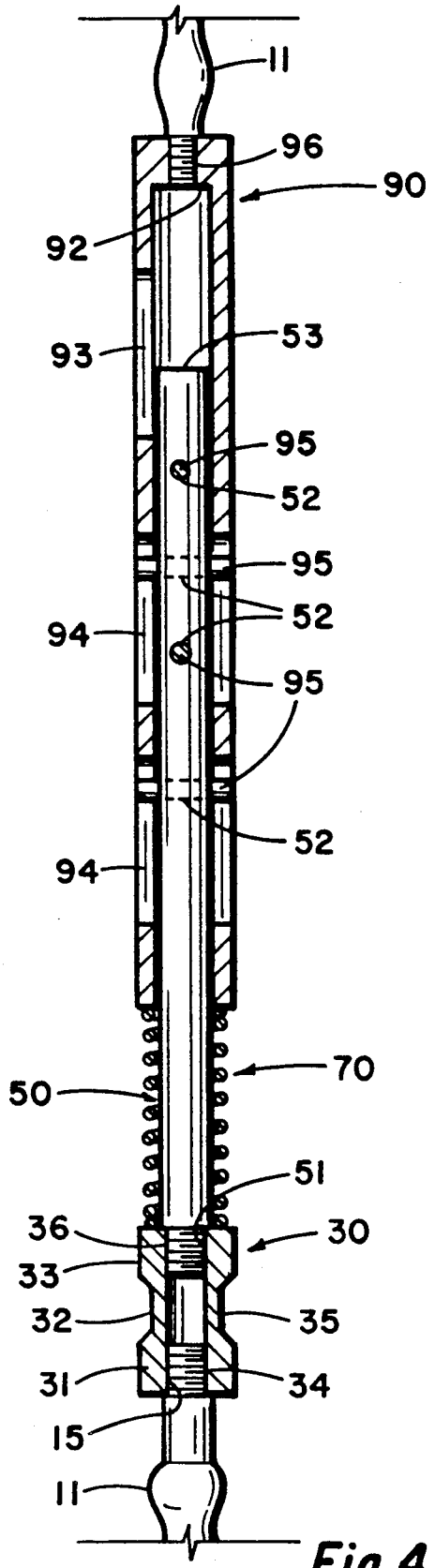
FIG. 4 is a cross-sectional view of the preferred embodiment of FIG. 2 illustrating the relationship of the parts of the shock absorber at the end of the pump downstroke.

In the preferred embodiment of the downhole shock absorber illustrated in FIG. 2, a substantially cylindrical coupling 30 has lower 31, intermediate 32 and upper 33 segments in vertical coaxial arrangement. As shown in FIGS. 3 and 4, the lower segment 31 has internal threads 34 to be screwed onto complementary external threads 15 on the upper end of a sucker rod string member 11, preferably the lowest such member of the string 10. The intermediate segment 32 may be provided with flats 35 to facilitate handling the coupling 30 with tools. The upper segment 33 also has internal threads 36.

Figure 7:
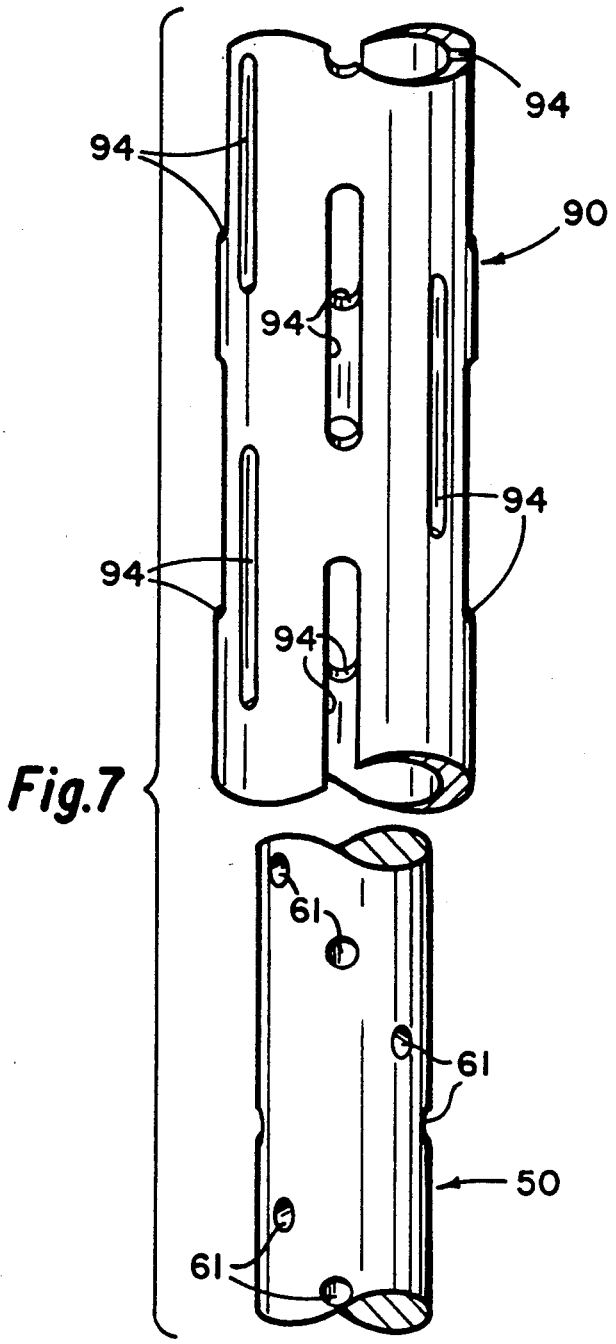
FIG. 7 is a perspective view of an alternate embodiment of the shaft and cylinder used in the preferred embodiment of FIG. 2 or other embodiments of the shock absorber.

A shaft 50 is mounted vertically on the coupling 30. Preferably, the shaft 50 will have external threads 51 on its lower end which complement and are screwed into the internal threads 36 on the upper segment 33 of the coupling 30. The upper portion of the shaft 50 has a plurality of diametric holes vertically displaced through it. In the preferred embodiment shown in FIGS. 2, 3 and 4, four such holes 52 are used with alternate holes being at right angles to each other. In the embodiment shown in FIGS. 7 and 8, eight holes 61 are used (only six shown) which are sequentially circumferentially offset by 45°. In both embodiments, as shown, vertically aligned holes are equally spaced apart. However, the number of holes, the circumferential offset of the holes and the vertical displacement of the holes can be varied to meet specific application requirements for strength.

The coupling 30 may be an integral part of the shaft 50. Both the coupling 30 and the shaft 50 will be made of steel, but composition can be changed to suit the specific characteristics of a particular well fluid. Preferably, the shaft 50 will be a solid rod made of steel bar stock.

Figure 6:
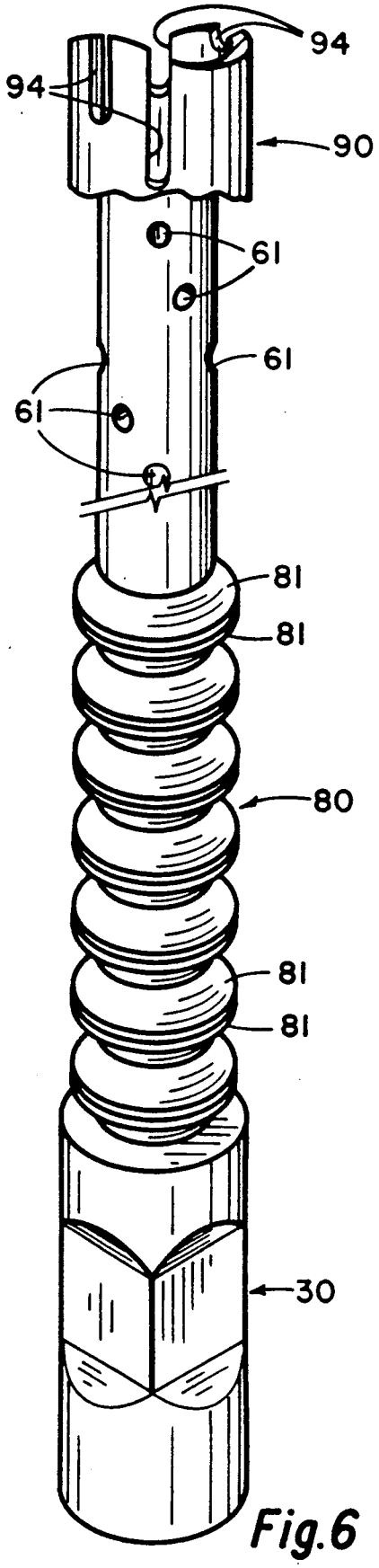
FIG. 6 is a perspective view with parts broken away of an alternate embodiment of the spring which may be used in the preferred embodiment of FIG. 2 or other embodiments of the shock absorber.

A spring 70 slides over the shaft 50 and is seated atop the coupling 30. The spring 70 used in the preferred embodiment of FIGS. 2, 3 and 4 is a cylindrical, helical spring. In the embodiment shown in FIG. 6, the spring 80 consists of a stack of alternately faced, cymbal-like plates 81 with a central, circular hole for mounting on the shaft 50, sometimes called a Belleville washer spring. Other variations of the spring are possible. However, the outer diameter of the spring should be less than the outer diameter of the coupling 30 so that the coupling 30 will protect the spring from wearing against the production tubing 13. The length of the spring should be such that the top of the spring does not reach the bottom hole of the shaft 50 when the spring is fully expanded. The spring should be selected to provide in the range of 1" to 2" of compression under expected loads with a maximum compression of approximately 3" prior to exceeding the spring's elasticity. The composition of the spring will be selected according to the strength and fluid requirements of the application. In conditions where corrosion due to presence of hydrogen sulfide or carbon dioxide is likely, plastic or rubber springs may be used, such as ultra high molecular weight polyathylene.

A cylinder 90 also slides over the shaft 50 with the bottom 91 of the cylinder 90 slidable into and out of abutment with the top 71 of the spring 70. The length of the cylinder 90 is such that, with the cylinder 90 seated on the spring 70 and the spring 70 fully compressed, the upper end 53 of the shaft 50 falls short of the top 92 of the cylinder 90. A relief port 93 is disposed through the cylinder wall at a level such that the port 93 lies above the top 53 of the shaft 50 when the spring 70 is compressed to its elastic limit. The port 93 may be a slot as shown or be any suitable configuration that will operate as a pneumatic outlet to relieve fluid or gas pressure in the cylinder 90 during the compression stroke or to release any vacuum that might occur during the expansion stroke. For example, a small circular hole could suffice but would not be preferred in high pressure conditions because higher velocity flow through the hole could tend to cause the production tubing to erode at the point of impact. The cylinder 90 is also provided with a plurality of vertical slots 94. Pairs of slots 94 are diametrically opposed. The bottom of each slot 94 is established so that, when the spring 70 is fully expanded and the cylinder 90 is seated on the spring 70, the bottom of each pair of slots 94 will align with or lie slightly below the corresponding hole 52 through the shaft 50. The top of each slot 94 is established so that, when the spring 70 is fully compressed and the cylinder 90 is seated on the spring 70, the top of each pair of slots will be above its corresponding hole 52 through the shaft 50. A plurality of pins 95 are snugly fitted through the holes 52 in the shaft 50. The pins 95 have a length equal to or slightly greater than the diameter of the cylinder 90 so that the ends of the pins 95 protrude into their respective slots 94 and reciprocally slide in the slots 94 during compression and expansion of the shaft 50 and cylinder 90. Because of their length, the upper ends of the slots 94 will never engage their respective pins 95, even during maximum compression. But the lower ends of the slots 94 will engage their respective pins 95 when or shortly after the spring 70 is fully expanded.

Figure 5:
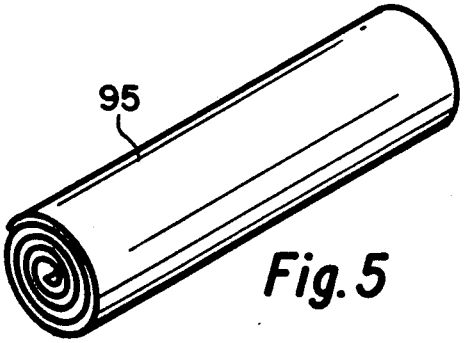
FIG. 5 is an exploded perspective view of the pins used in the preferred embodiment of FIG. 2.

As shown in FIG. 5, the pins 95 are preferably a flexibly resilient, spiraled coil of steel. However, alternative pins that meet necessary shear and strength requirements can be used.

The upper end of the cylinder 90 is adapted to be coaxially mounted in the sucker rod string 10. As shown in FIGS. 3 and 4, the upper end of the cylinder 90 has internal threads 96 which may be screwed into complementary external threads on the lower end of a sucker rod string member 11 above the cylinder 90.

In a given system, the diameter of the shaft 50 will be controlled by the diameter of the production tubing, the size of the pins 95 will be controlled by the diameter of the shaft 52 so as to maintain the structural integrity of the shaft 52 and the number of pins 95 will be controlled by the size of the pins 95 to provide the necessary strength to withstand shear. It is desirable that the spring 70 will fail before the pins 95 shear and that the pins 95 will shear before the shaft 52 fails.

In operation, the assembled shock absorber is installed in the sucker rod string 10 of the pumping system by connecting the lower threaded coupling segment to the selected string member 11 above the pump, preferably the pull rod. The upper portion of the cylinder 90 is connected to the next upward string member 11. As the pump operates, the shaft 50 functions as a piston in the cylinder 90. During the downstroke, the force exerted on the cylinder 90 by the string member 11 above it drives the bottom of the cylinder against the spring 70. The spring 70 guided by the shaft 52, in turn drives the coupling 30 and the string member 11 to which the coupling 30 is connected to deliver the downstroke to the pump. If the pump is not filled with oil, the acceleration on the downstroke will result in the pounding effect upon contact of the pump valve with fluid. This force is now absorbed by the compression of the spring 70 rather than be transmission of the force through the rod string 10 to string members 11 and other parts of the pump system. As was earlier pointed out, the slots 94 are large enough that, even at maximum compression of the spring 70 beyond its elastic limits, the top of the slot 94 does not engage the pins 95. Therefore, even if the spring is compressed to the maximum and destroyed, the force will not be applied to the pins 95. This is important because, if the pins 95 were sheared, removal of the damaged spring 70 would be more complicated. During the downstroke, the relief port 93 allows gas or fluid in the cylinder 90 to be released so that the pounding force to be absorbed by the spring 70 is not transferred to the rod string 10 by the pressure in the cylinder 90.

On the upstroke the cylinder 90 is lifted and the spring 70 expands. As the spring 70 reaches full expansion, or shortly thereafter, the pins 95 engage the bottom edges of the slots 94 to lift the pins 95 and therefore the shaft 50, the coupling 30 and the sucker rod member 11 connected to the pump.

Throughout the reciprocating motion of the piston 50 and the cylinder 90, the pins 95 guide relative vertical motion of the piston 50 and cylinder 90 and prevent relative rotational motion of the piston 50 in the cylinder 90.

If it becomes necessary to replace the spring 70 for any reason, the shock absorber may be pulled from the well with the sucker rod string 11. The pins 95 are then punched out of the holes 52 and the piston 50 and the cylinder 90 separated. The spring 70 is easily replaced on the piston 50 and the cylinder 90 mounted on the piston 50. The pins 95 may be reinserted or replaced. The shock absorber is then ready for reinsertion into the well.

Thus it is apparent that there has been provided, in accordance with the invention, a downhole shock absorber that fully satisfies the objects, aims, and advantages set forth above. While the invention has been described in conjunction with a specific embodiment thereof, it is evident that many alternatives, modifications, and variations will be apparent to those skilled in the art in light of the foregoing description. Accordingly, it is intended to embrace all such alternatives, modifications, and variations as fall within the spirit of the appended claims.

What is claimed is:

1. In a well pump system the combination comprising:

a sucker rod string;

a pump reciprocable in response to said string;

a cylinder;

a piston disposed for vertical reciprocal motion within said cylinder;

means for biasing said cylinder and said piston against compressive motion;

means for pneumatically relieving pressure in said cylinder during compressive motion; and means for preventing relative rotational motion and for limiting relative expansive motion between said cylinder and said piston;

said cylinder and said piston being coaxially mounted in said sucker rod string proximate and above said pump to buffer forces transmitted through said string.

2. For use with a well pump mounted at the bottom of a sucker rod string, a downhole shock absorber comprising:

a vertical cylinder, the top of said cylinder being adapted for connecting said cylinder to the lower end of a sucker rod at or near the bottom of the string;

a vertical piston having its upper portion disposed for coaxial reciprocal motion within the lower portion of said cylinder, the bottom of said piston being adapted for connecting said piston to the upper end of the next lower sucker rod of the string;

means mounted on said piston and engaged with said cylinder for resiliently biasing said cylinder against downward motion in relation to said piston;

means in pneumatic communication with the portion of said cylinder above said piston for relieving pressure in said cylinder as said piston moves upwardly therein; and means disposed on said piston and said cylinder for guiding their reciprocal motion and for limiting the range of upward motion of said cylinder in relation to said piston to a point at or slightly higher than the zero bias condition of said biasing means.

3. For use with a well pump system in which the pump is mounted at the bottom of a sucker rod string, a downhole shock absorber comprising:

a cylinder adapted to be fixed in coaxial alignment to a sucker rod disposed above said cylinder;

a piston adapted to be fixed in coaxial alignment to a sucker rod disposed below said piston, said piston being disposed within said cylinder for relative vertical reciprocal motion in response to forces exerted on the sucker rods to which said cylinder and said piston are fixed;

a spring coaxially disposed about the lower portion of said piston and having its lower end fixed in relation to said piston and its upper end aligned for abutment with said cylinder for biasing said cylinder against downward motion in relation to said piston;

means in pneumatic communication with said cylinder for relieving pressure in said cylinder during relative upward motion of said piston; and means disposed on said piston and said cylinder for preventing relative rotational motion therebetween and for limiting the relative downward motion of said piston in said cylinder.

4. A downhole sucker absorber according to claim 3, the length of said spring being such that said spring may be fully compressed during the downstroke of said cylinder.

5. A downhole shock absorber according to claims 3 or 4, said limiting means limiting the relative downward motion of said piston in said cylinder to a point at or slightly below which said spring may be fully expanded.

6. For use with a well pump mounted at the bottom of a sucker rod string, a downhole shock absorber comprising:

a substantially cylindrical coupling;

a vertical shaft extending upwardly from said coupling and having a plurality of vertically displaced diametric holes disposed through its upper portion;

a spring slidably, coaxially disposed on said shaft below said holes and seated on said coupling, said spring having an outer diameter less than the outer diameter of said coupling;

a plurality of pins, one each snugly disposed through each of said holes and protruding beyond the circumference of said shaft; and a cylinder slidably disposed on said shaft and seated on said spring, said cylinder having a length greater than the length of the portion of said shaft extending above said coupling less the compressed length of said spring, said cylinder having at least one relief port disposed therethrough and above said shaft when said spring is compressed to its elastic limit, said cylinder having a plurality of vertical slots, two each aligned with each of said pins with opposite ends of said pins protruding into their respective slots for slidable reciprocal motion therein, said slot having a length such that the upper end of each said slot does not engage is respective bin when said spring is fully compressed and the lower end of each said slot engages its respective pin when or after said spring is fully expanded, the lower end of said coupling and the upper end of said cylinder being adapted to coaxial mounting in the sucker rod string proximate the pump whereby the shock absorber buffers forces transmitted through the string.

7. A downhole shock absorber according to claim 6, said coupling having an internally threaded lower segment screwable onto the complementary externally threaded upper end of a member of the sucker rod string.

8. A downhole shock absorber according to claim 6 or 7, said coupling having an internally threaded upper segment and said shaft having a complementary externally threaded lower segment screwable therein.

9. A downhole shock absorber according to claims 6 or 7, said cylinder having an internally threaded upper end screwable onto a complementary threaded lower end of a member of the sucker rod string.

10. A downhole shock absorber according to claim 6, said shaft being a solid rod.

11. A downhole shock absorber according to claim 6, said holes being equally, sequentially, circumferentially offset.

12. A downhole shock absorber according to claim 11, aligned ones of said holes being equally vertically displaced.

13. A downhole shock absorber according to claims 11 or 12, said holes being sequentially, circumferentially offset at a multiple of 45°.

14. A downhole shock absorber according to claim 12, said aligned ones of said holes being vertically displaced in the range of 1" to 2" on center.

15. A downhole shock absorber according to claims 6 or 10, said slots being in the range of 4" to 6" in length.

16. A downhole shock absorber according to claims 6 or 10, said pins and holes being approximately ½ in diameter.

17. A downhole shock absorber according to claim 6, said pins comprising a flexibly resilient spiraled coil of steel.

18. A downhole shock absorber according to claims 6 or 17, said pins having a length equal to or slightly greater than the outer diameter of said cylinder.

19. A downhole shock absorber according to claim 6, said spring being cylindrically helical.

20. A downhole shock absorber according to claim 6, said spring comprising a stack of alternately faced, cymbal-like plates having a central circular holes therethrough.

21. A downhole shock absorber according to claims 6, 19 or 20, said springs having a maximum compression of approximately 3" without deformation.

22. A downhole shock absorber according to claim 6, said relief port being a vertical slot.

23. For use with a well pump mounted at the bottom of a sucker rod string, a downhole shock absorber comprising:

a substantially cylindrical coupling having coaxial, internally threaded upper and lower segments, said lower segment being screwable into the complementary threaded upper end of a member of the sucker rod string;

a shaft having a threaded lower end complementary to and screwed into said threaded coupling upper segment, said shaft having a plurality of diametric holes disposed along its upper portion;

a spring slidably, coaxially disposed on said shaft below said holes and seated on said coupling, said spring having an outer diameter less than the outer diameter of said coupling;

a plurality of pins, one each snugly disposed through each of said holes and protruding beyond the circumference of said shaft; and a cylinder slidably disposed on said shaft and seated on said spring, said cylinder having a length greater than the length of the portion of said shaft extending above said coupling less the compressed length of said spring, said cylinder having at least one relief port disposed therethrough above said shaft when said spring is compressed to its elastic limit, said cylinder having a plurality of vertical slots, two each aligned with each of said pins with opposite ends of said pins protruding into their respective slots for slidable reciprocal motion therein, said slots having a length such that the upper end of each said slot does not engage its respective pin when said spring is fully compressed and the lower end of each said slot engages its respective pin when or after said spring is fully expanded and said cylinder having an internally threaded upper end screwable into a complementary threaded lower end of a member of the sucker rod string disposed above said cylinder.

24. A downhole shock absorber according to claim 23, said shaft being a solid rod.

25. A downhole shock absorber according to claims 23 or 24, said holes equally, sequentially, circumferentially offset with vertically aligned holes being equally vertically displaced.

26. A downhole shock absorber according to claims 23 or 24, said pins comprising a flexibly resilient, spiraled coil of steel having a length equal to or slightly greater than the outer diameter of said cylinder.

27. For use with a well pump mounted at the bottom of a sucker rod string, a downhole shock absorber comprising:

a substantially cylindrical coupling having coaxial, internally threaded upper and lower segments, said lower segment being screwable into the complementary threaded upper end of a member of the sucker rod string;

a shaft having a threaded lower end complementary to and screwed into said threaded coupling upper segment, said shaft having a plurality of diametric holes disposed along its upper portion, said holes being equally sequentially circumferentially offset with vertically aligned holes equally vertically displaced;

a spring slidably, coaxially disposed on said shaft below said holes and seated on said coupling, said spring having an outer diameter less than the outer diameter of said coupling;

a plurality of pins, one each snugly disposed through each of said holes and protruding beyond the circumference of said shaft, each of said pins being a flexibly resilient spiraled coil of steel;

a cylinder slidably disposed on said shaft and seated on said spring, said cylinder having a length greater than the length of the portion of said shaft extending above said coupling less the compressed length of said spring, said cylinder having at least one relief port disposed therethrough above said shaft when said spring is compressed to its elastic limit, said cylinder having a plurality of vertical slots, two each aligned with each of said pins with opposite ends of said pins protruding into their respective slots for slidable reciprocal motion therein, said slots having a length such that the upper end of each said slot does not engage its respective pin when said spring is fully compressed and the lower end of each said slot engages its respective pin when or after said spring is fully expanded, and said cylinder having an internally threaded upper end screwable into a complementary threaded lower end of a member of the sucker rod string disposed above said cylinder.

28. A downhole shock absorber according to claim 27, the length of said pins being equal to the diameter of said cylinder.

29. A downhole shock absorber according to claims 27 or 28, said shaft being a solid rod.

30. A downhole shock absorber according to claims 27 or 28, the vertical displacement of said aligned holes being in the range of 1" to 2", the circumferential offset of said holes being in a multiple of 45°, said slots being in the range of 4" to 6" in length, said holes and said pins being approximately ½" in diameter, and said spring having a maximum compression of approximately 3" without deformation.

* * * * *